US007530447B2

(12) United States Patent
Fritsche et al.

(10) Patent No.: US 7,530,447 B2
(45) Date of Patent: May 12, 2009

(54) DEVICE FOR EFFECTING THE POSITIONALLY ACCURATE CONVEYANCE OF FLAT-ARTICLES TO BE SORTED TO AN INPUT DEVICE FOR A SORTING CONVEYOR

(75) Inventors: Beat Fritsche, Greifensee (CH); Thomas Zimmermann, Wutoeschingen (DE)

(73) Assignee: Siemens Schweiz AG, Zurich (CH)

( * ) Notice: Subject to any disclaimer, the term of this patent is extended or adjusted under 35 U.S.C. 154(b) by 78 days.

(21) Appl. No.: 11/701,928

(22) Filed: Feb. 2, 2007

(65) Prior Publication Data

US 2007/0132175 A1 Jun. 14, 2007

Related U.S. Application Data

(62) Division of application No. 11/113,069, filed on Apr. 25, 2005, now abandoned.

(51) Int. Cl.
*B65H 5/02* (2006.01)

(52) U.S. Cl. ..... 198/644; 271/4.09; 271/3.2; 271/225; 271/185

(58) Field of Classification Search ..... 198/644; 271/4.09, 3.18, 3.2, 3.21, 225, 184, 185, 271/191, 200

See application file for complete search history.

(56) References Cited

U.S. PATENT DOCUMENTS

| | | | | | |
|---|---|---|---|---|---|
| 3,932,982 | A * | 1/1976 | Klapp | 53/244 |
| 4,161,092 | A * | 7/1979 | Buday et al. | 53/244 |
| 4,161,095 | A * | 7/1979 | Buday | 53/527 |
| 4,237,677 | A * | 12/1980 | Klapp | 53/505 |
| 4,241,559 | A * | 12/1980 | Klapp | 53/244 |
| 4,676,050 | A * | 6/1987 | Odenthal | 53/447 |
| 6,688,593 | B1 * | 2/2004 | Auerbach | 271/184 |

FOREIGN PATENT DOCUMENTS

GB 2182315 A * 5/1987

* cited by examiner

*Primary Examiner*—Mark A Deuble
(74) *Attorney, Agent, or Firm*—Laurence A. Greenberg; Werner H. Stemer; Ralph E. Locher

(57) ABSTRACT

A device for effecting the positionally accurate conveyance of flat articles to be sorted to an input device for a sorting conveyor has a draw-off unit and a feed unit. The draw-off unit periodically separates the flat articles to be sorted, and feeds them in separated form onto a conveyor line. The feed unit transfers the separated articles with a defined advance to the input device after these articles have reached a predetermined conveyance location of the conveyor line. A section of the conveyor line immediately preceding the predetermined conveyance point is arranged substantially vertical and includes a pair of belts for guiding the article to be sorted, with one belt of the pair running around two rollers and the other belt of the pair configured to be raised for a predetermined time.

10 Claims, 5 Drawing Sheets

DEVICE FOR EFFECTING THE POSITIONALLY ACCURATE CONVEYANCE OF FLAT-ARTICLES TO BE SORTED TO AN INPUT DEVICE FOR A SORTING CONVEYOR

CROSS REFERENCE TO RELATED APPLICATIONS

The present application is a divisional application of U.S. application Ser. No. 11/113,069, filed on Apr. 25, 2005, which is a continuation of International Application No. PCT/EP2003/007082, filed Jul. 3, 2003, which designated the United States and further claims priority to European Patent Application No. 02023579.2, filed Oct. 23, 2002, which are hereby incorporated by reference.

BACKGROUND OF THE INVENTION

The invention relates to a device for effecting the positionally accurate conveyance of flat articles to be sorted to an input device for a sorting conveyor.

This type of device is usually used in a sorting conveyor for post automation, such as that described for example in European Patent Application EP 827 786 A1. Usually this sorting conveyor has what are known as feed devices which feed the flat articles to be sorted into pockets in a circulating conveyor system. From these pockets the flat articles to be sorted are emptied out into the physical destination points to be assigned to them in each case and can then be conveyed to their intended destination.

The sorting of flat articles to be sorted is comparatively demanding to the extent that the dimensions and handling characteristics of flat goods to be sorted vary within wide constraints. On the one hand, from the format standpoint alone, an almost unlimited plurality of different dimensions exist in the width, height and thickness of the articles. Furthermore a very wide range of packaging and stiffness of flat articles for sorting is encountered, the opposite ends of which are represented by rather hard, stiff cardboard envelopes and by rather soft brochures and periodicals packed in foil. A particular problem is posed here by what are known as bulk mailings, which as a rule contain promotional materials and often simply consist of a collection of loose sheets with additional advertising inserts which project beyond the dimensions of the other sheets.

Usually these types of bulk mailings, but also other flat articles to be sorted are placed in horizontally supported stacks in the conveyor unit mentioned above and must be removed from this stack individually, which in itself is already a technically very challenging task. To enable these flat articles for sorting, which are as a rule in a horizontal position, to be fed by a feed device into the circulating sorting conveyor, these articles need to be moved into a vertical position. This raising into an upright position however in its turn makes it necessary for the articles to be sorted to be very accurately positioned before being fed to the device for raising the articles into an upright position. Another complicating factor here is that it is precisely the less rigid and less homogeneous per se articles to be sorted, e.g. the bulk mailings mentioned above, that are difficult to handle and thus cannot be fed automatically as a rule, but must be positioned manually from an input station onto the feed device, which represents a significant cost factor.

SUMMARY OF THE INVENTION

The underlying object of the invention is therefore to specify a device for effecting the positionally accurate conveyance of flat articles to be sorted to an input device for a sorting conveyor which makes it possible to convey in particular the particularly problematic articles to be sorted mentioned above with sufficient accuracy for further processing.

This above-mentioned object is achieved with a device of the type mentioned at the start in accordance with the invention in that, a draw-off unit which periodically separates the flat articles to be sorted, feeds the flat articles to be sorted in separated form to the conveyor line and a feed unit transfers the separated articles to be sorted, after these articles to be sorted have arrived at a predetermined location of the conveyor line, with of a defined advance of the input device.

In this way it is guaranteed that an article to be sorted, as a result of this defined advance, is positioned with a defined end position in the input device, so that subsequent processing, particularly the vertical raising of the article to be sorted can be effected in a reliable and automated manner. In this case the format and the structure of the article to be sorted are of no additional importance since, with the arrival of the article to be sorted at the predetermined location a specific translation of the article to be sorted by exactly the extent of the preset advance ensues.

With bulk mailings in particular with loose leaf inserts and such like it is of particular importance that a comparatively stable edge, for example the folded edge, can be arranged to be at the bottom when the article to be sorted is raised vertically. To this end a particular embodiment of the invention makes provision for the articles to be sorted which feature a leading edge, to be able to be placed in a stack in the draw-off unit and to be able to be transferred to the conveyor line with their leading edge facing forwards.

An especially operationally secure embodiment of this previously mentioned characteristic can provide for the draw-off unit to feature a drum-type, rotatable unit which has suction cups and a transport protection element, where with the suction cups provision is made for gripping the article to be sorted lying closest to the drum and subsequently with the transport protection element for an edge, especially the leading edge of the article to be sorted in contact with the suction cup, to be able to be gripped. In this way the suction cups can suck up an article to be sorted lying at the bottom of the stack close to the edge and because of the circular path of the drum, separate it from the articles to be sorted lying above it. Subsequently the transport protection element controlled by the circular movement, for example a lever pressing onto the article to be sorted with the edge, grips the article to be sorted which is now drawn out of the stack and is conveyed on the circular path into a suitable position.

In this case it is especially worthwhile, if, for depositing the article to be sorted on the conveyor line, after a specifiable angle of rotational movement in each case, the suction of the suction cups can be reduced again and the transport protection element can be removed from the edge. The article to be sorted thus lies on the conveyor line so that it can be freely conveyed which does not necessarily have to mean absolutely that the article to be sorted is placed in a horizontal position, since the circular movement of the drum-type unit also allows other positions.

In a useful embodiment of the invention the predetermined conveyor location can be represented by light barrier assigned to the conveyor line and/or by a movement sensor assigned to the conveyor line. In addition or alternatively the predetermined conveyor location can be simultaneously or alternatively represented by the end of the conveyor line.

A mechanically especially reliable to operate and simple to construct feed unit is produced when the feed unit comprises a telescopic unit with a movable carriage, with the carriage moves out when the article to be sorted arrives at the predetermined conveyor position and where the defined advance corresponds to the predetermined outwards movement path. In this case the moving out and also the subsequent moving in can be activated by electric motors, but also pneumatically. In accordance with the control of these activation elements, the draw-off path can thus be changed within expedient limits, so that the draw-off path can be very much shorter than the length of the draw-off means available, e.g. a draw-off rail.

To be able to ensure that the defined point for the transfer of the article to be sorted to the input device is always adhered to, even in ongoing automated operation, the carriage of the telescopic unit will be set so that it is returned to its rest position before the article to be sorted which follows the article to be sorted that has just been ejected reaches the predetermined conveyance point. It should be pointed out here that the next article to be sorted can have been already completely transported over the carriage as it moves back to the predetermined conveyance point. The only important factor is that the carriage has returned to its rest position at least by the time that the article to be sorted has reached the predetermined conveyance point and thereby the transfer of the article to be sorted onto the carriage is due immediately.

In an especially advantageous embodiment of the telescopic unit the carriage of the telescopic unit can have a surrounding transport belt, which is not driven for the ejection movement and is driven for the insertion movement. It is thus possible for the location of the article to be sorted to remain unchanged during the ejection movement relative to the carriage and during the insertion movement correspondingly by a suitable drive movement of the conveyor belt for the placing/transfer of the article to be sorted on/to the input device to be supported.

Especially critical for the placement/transfer of the article to be sorted from the carriage on/to the input device is the insertion movement in the backwards direction of the carriage. This insertion movement in a backwards direction is relatively equalized for the article to be sorted if a drive element for the transport belt of the carriage is coupled to the movement of the carriage, with free movement being provided for the ejection movement and for the insertion movement the speed of the transport belt being proportionally matched at least largely to the speed of the insertion movement but with a reverse sign.

A further especially advantageous and simple to construct variant for the telescopic unit provides for a telescopic unit comprising at least one system of two pairs of rollers coupled via an closed belt which has the following features:

a) the relative position of the two rollers within a pair to each other is fixed;

b) one pair of rollers is arranged in a fixed location and the other pair of rollers is attached to the carriage which undertakes the ejection and insertion movement;

c) each pair of rollers comprises; at least one roller equipped with a free wheel, so that c1) when the carriage is ejected, the belt only rolls over the rollers of the fixed pair of rollers, and c2) on insertion of the carriage the belt only rolls over the rollers attached to the carriage.

This means that on the carriage separate drive elements to drive of the belt for the insertion movement are no longer needed, because the belt on insertion corresponding to the backwards movement of the two rollers of the carriage rolls in the direction of conveyance and the article to be sorted does not sense that the carriage is removing itself from under it. It thus remains exactly in the end position of the ejection movement, which was absolutely what was intended. Thanks to the freewheel provided for each pair of rollers the belt remains unchanged in the area of the carriage for the ejection movement, because the belt for the ejection movement rolls over the rollers of the fixed pair of rollers and rollers of the carriage do not allow the carriage to roll over these rollers on account of the freewheel which now has a blocking effect.

To enable the article to be sorted to be transferred especially well to the conveyor line, both the conveyor line at least in the area of the rest position of the carriage of the telescopic unit well as the carriage can feature strip-type spaced conveyor belts, with the strip-type conveyor belts of the conveyor line and the telescope draw-off units being arranged alternately to each other. In this way a type of transfer zone is produced so to speak which is at the same time the (end) component of the conveyor line and the carriage.

So that the number of cycles can also be set comparatively high, it is possible, as already mentioned above, even when the carriage is still moving back, to transport articles to be sorted into the above-mentioned transfer zone. So that in this case the effect of the returning carriage on the articles to be sorted being transported in the opposite direction remains negligible, the level of the strip-type belts of the carriage which serves as a support for the article to be sorted is arranged slightly lower than the level of the strip-type belts of the conveyor line, on which the article to be sorted is conveyed in. Only with the ejection of the carriage and the onward transport of the article to be sorted over the end of the conveyor line does the carriage then accept the article to be sorted on the move. In this case significant support can be given to this transfer by the belt or belts of the carriage featuring an adhesive surface. In addition or as an alternative, the articles to be sorted can also be held in a suitable way on the carriage—even if not firmly held in the strictest sense. To this end the articles to be sorted, until they reach the predetermined conveyance location, can be bought into contact with a spring element running on rollers which (lightly) presses the article to be sorted onto the belt or belts of the carriage.

A further feature to support the transfer from the conveyor line to the carriage can be achieved when the carriage of the telescopic unit is set so that the carriage on transfer of the article to be sorted from the conveyor line to the carriage has at least approximately the speed of the article to be sorted transported on the conveyor line. This means that no difference in relative speed occurs on transfer of the article to be sorted from the conveyor line to the carriage, which means that no undesired movements of the article to be sorted are produced on the carriage. Such movements could otherwise for example result on acceleration of the carriage from the idle position with an article to be sorted already lying on it.

One solution based on a quite different approach to the above solutions to the task provides for an embodiment of the feed unit with a disk-type, rotating, non-rotationally symmetrical conveyor element which grips with the area further from its axis the articles to be sorted which have reached the predetermined conveyance location and in this way brings about the advance to the input device until the areas close to the axis lose their grip on the article to be sorted. In this way the articles to be sorted are carried on the conveyor element for as long as areas further away from the axis grip the article to be sorted, so that in this way too a defined advance can be achieved. Depending on the thickness of the articles to be sorted a height adjustment for the conveyor element can be provided, so that as a result different thicknesses of articles to be sorted still remain in contact with the conveyor element for the same length of time. Likewise a wobble plate which has the same effect can be provided, which, because of its imbalance is only ever in contact with the article to be sorted for a specific duration and thereby ensures a defined advance of the article to be sorted.

Further advantageous embodiments of the invention can be taken from the other subclaims.

BRIEF DESCRIPTION OF THE SEVERAL VIEWS OF THE DRAWINGS

Exemplary embodiments of the invention are explained in greater detail below on the basis of a drawing. The diagrams show.

DETAILED DESCRIPTION OF THE INVENTION

Figure 1:
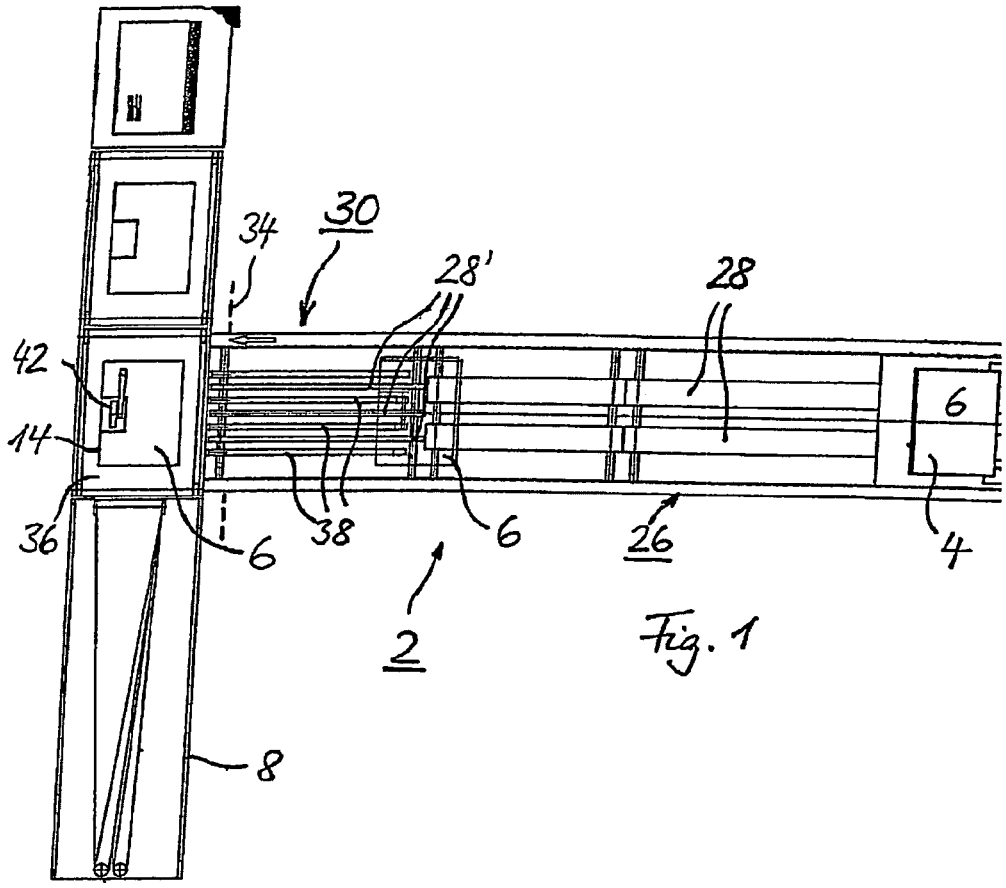
FIG. 1 a schematic diagram of an overhead view of a first positioning device with downstream input device.

FIG. 1 shows a schematic diagram of an overhead view of a first positioning device 2, with which flat articles to be sorted 6 located in a horizontal stack 4 are conveyed positionally accurately to a input device 8 of which a section is shown. The positionally accurate transfer is therefore so eminently important because the articles to be sorted 6 are subsequently turned in the part of the input device 8 shown here from the horizontal into the vertical position and then inserted with an insertion device not shown here into pockets of a sorting conveyor also not shown in this diagram. Because these process steps indicated here for sorting the articles to be sorted 6 are undertaken at a comparatively high sorting speed, it is very evident that the articles to be sorted 6 must be able to be handled very exactly at all times.

Figure 2:
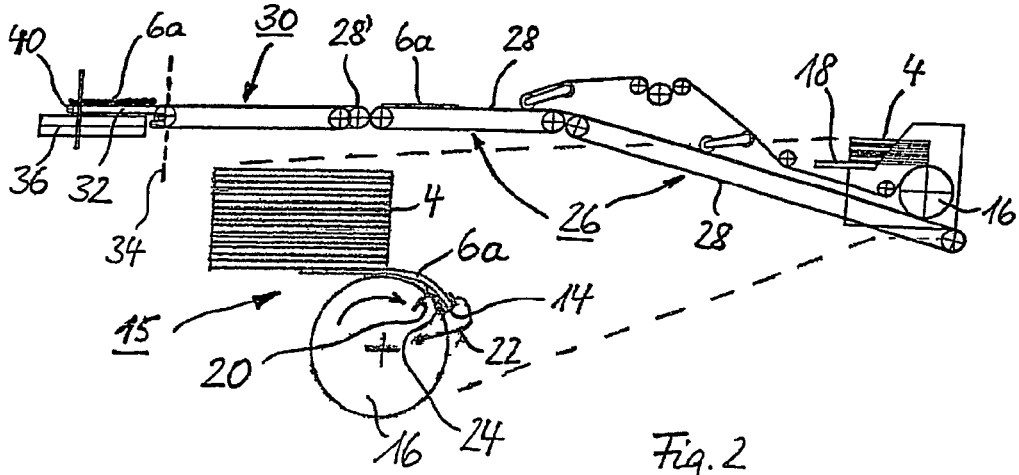
FIG. 2 a schematic diagram of a side view of the first positioning device.

The mode of operation of the first positioning device 2 is now described with reference to FIGS. 1 and 2, with this mode of operation basically also being applicable to a second positioning device 10 shown in greater detail in FIGS. 3 and 4 and a third positioning device 12 described in greater detail in FIGS. 5 and 6.

The flat articles to be sorted 6 are in the exemplary embodiment DIN A4 folded promotional brochures into which one or more loose inserts are placed. The brochures are not stapled, but only interleaved as a collection of loose sheets. It is clearly evident that these types of articles to be sorted 6 are extremely difficult to handle, since, with the exception of the folded edge, which is subsequently designated the leading edge 14, they do not provide any other gripping point for a positionally accurate automated transport.

These articles to be sorted 6 are now placed in the stack 4 via a separation drum 16 on a support 18. The separation streaming here is a component of a draw-off unit 15, which is shown offset within the dashed lines in FIG. 2 and enlarged to make for easier understanding. The article to be sorted 6*a* lying right at the bottom is then actively sucked up from below by means of suction cups 20, which are arranged on the rotating separation drum 16 and thus initially diverted downwards out of the stack 4. At the same time the sucked-up article to be sorted 6*a* is pressed down on its leading edge 14 by means of a lever 22 onto an opposing bearing 24 arranged opposite the separation drum 16, so that the article to be sorted 6*a* which is sucked by the suction cups and clamped with the lever 22 now follows the circular movement of the separation drum 16. After a rotation of 180° the vacuum of the suction cup 20 is released again and the lever 22 swung back from the opposing support 24 so that the article to be sorted 6*a* separated in this way is now transferred to a conveyor line 26, which by means of strip-type conveyor belts 28 conveys the separated article to be sorted 6*a* to a telescopic unit 30. The exception is the process of incorrectly simultaneously drawing-off of a number of articles to be sorted. In this case the lever 22 has a means not shown in greater detail for measuring thickness, for example by means of an inductive detector. If a multiple drawing off is now actually detected, these articles to be sorted are not output onwards to the conveyor line, but are channeled away into a storage unit not shown in greater detail here.

The telescopic unit 30 is described in greater detail below under FIGS. 7 and 8. At this point it is sufficient to say by way of explanation that a movable carriage 32 of the telescopic unit 30 travels outwards with the speed of the last strip-type belts 28' of the conveyor line 26 arranged in the conveyor line 26, i.e. undertakes an ejection movement when the leading edge 14 of the article to be sorted 6*a* reaches a light barrier 34. The carriage 32, which also has strip-type conveyor belt systems 38, in this case covers a defined path of advance and on its inwards movement, i.e. on completion of the insertion movement in the backwards direction, deposits the article to be sorted 6*a* onto a conveyor belt 36 of the input device 8 from where it is then transported in a direction at right angles to the previous direction of conveyance into the input device 8 and is turned into a vertical position. In this case an additional roller element 42 is provided, which presses down on the conveyor belt 36 just when the article to be sorted 6*a* is deposited, which contributes further to adhering to the precise placement of the article to be sorted 6*a*.

To be able to deposit the article to be sorted 6*a* positionally accurately on the conveyor belt 6, i.e. in detail, for the leading edge 14 always to come to rest at the same point, there is provision with the insertion movement for the backwards directed movement of the carriage 32 to be equalized by rolling the conveyor belt system 38 over the front edge 40 lying adjacent to the leading edge 14. It is therefore a particular feature of the present invention that the relative position of the leading edge 14 to the front edge 40 of the carriage 32 remains unchanged for the ejection movement and that the front edge 40 for the insertion movement to move back relative to the leading edge 14, which however for the article to be sorted 6*a* is equalized seen in relative terms by the conveyor belt system 38 rolling over the front edge 40. In this way the positionally accurate location of the article to be sorted 6*a* is retained even during the insertion movement of the carriage, which is of great significance for the onwards conveyance of the article to be sorted 6*a* and is a major intended objective of the positioning device 2.

Figure 3:
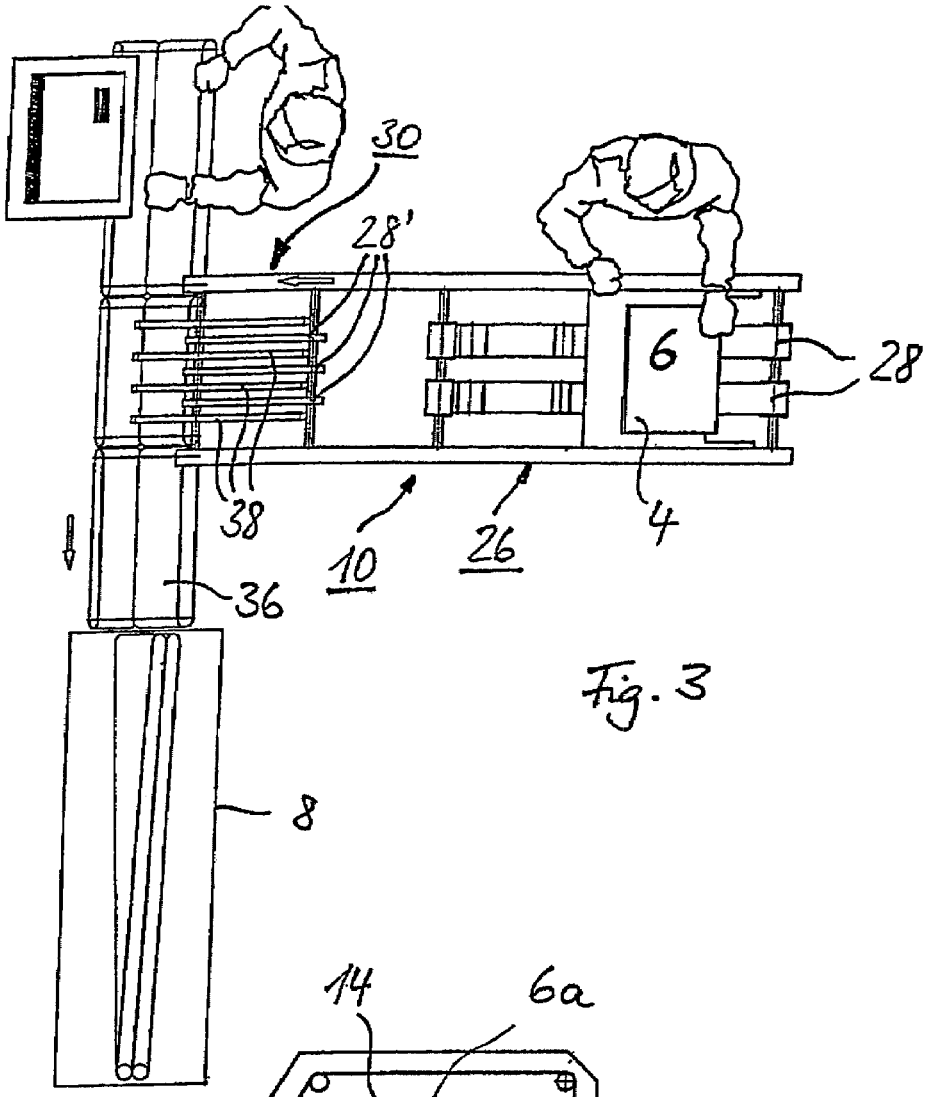
FIG. 3 a schematic diagram of an overhead view of a second positioning device with downstream input device.
Figure 4:
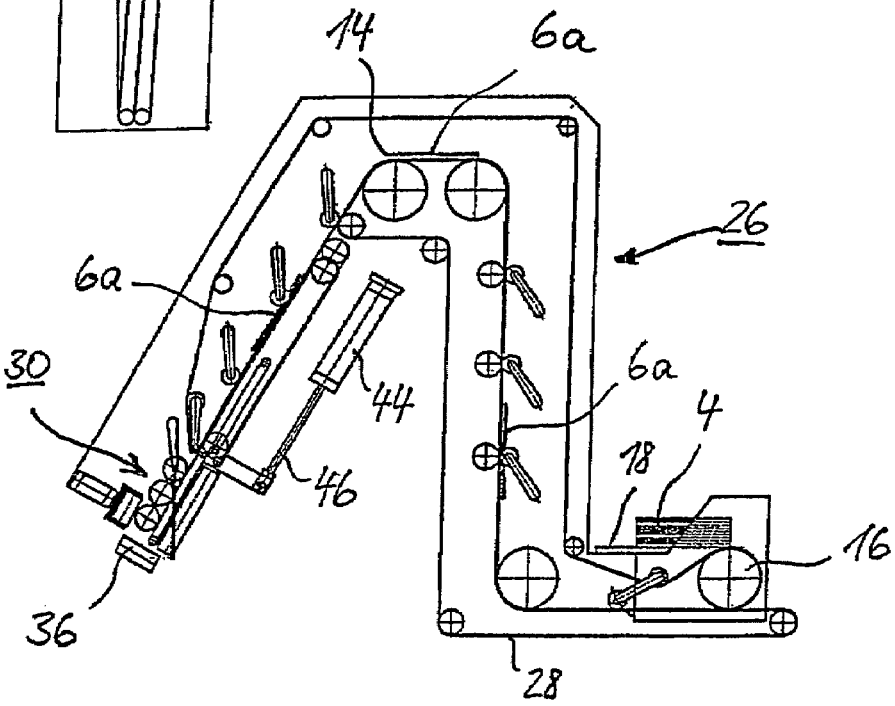
FIG. 4 a schematic diagram of a side view of the second positioning device.

For the second positioning device which is only slightly modified in relation to the first positioning device 2 it can clearly be seen on the basis of FIGS. 3 and 4 that in principle only the path of the conveyor line 26 has changed. To save space as regards the width of the unit the available height has been used and the articles to be sorted 6*a* separated with the separation drum 16 are first moved vertically for a distance, then horizontally and finally at an angle downwards to the telescopic unit 30. Here too a light barrier, not shown in any greater detail, is provided, which leads to the carriage 32 being ejected when an article to be sorted 6*a* reaches it. In addition to the components of the telescopic unit 30 shown thus far, a pneumatic unit 44 with of a push rod 46 driven by it, which is coupled to the carriage 32 are shown. The pneumatic unit 44 could also be replaced by an electric motor drive for the push rod 46 which under suitable conditions could also make lower-noise operation possible. As with the previous variant of the embodiment, the telescopic unit 30 is also in the moved-out position for the second positioning device 10.

Figure 5:
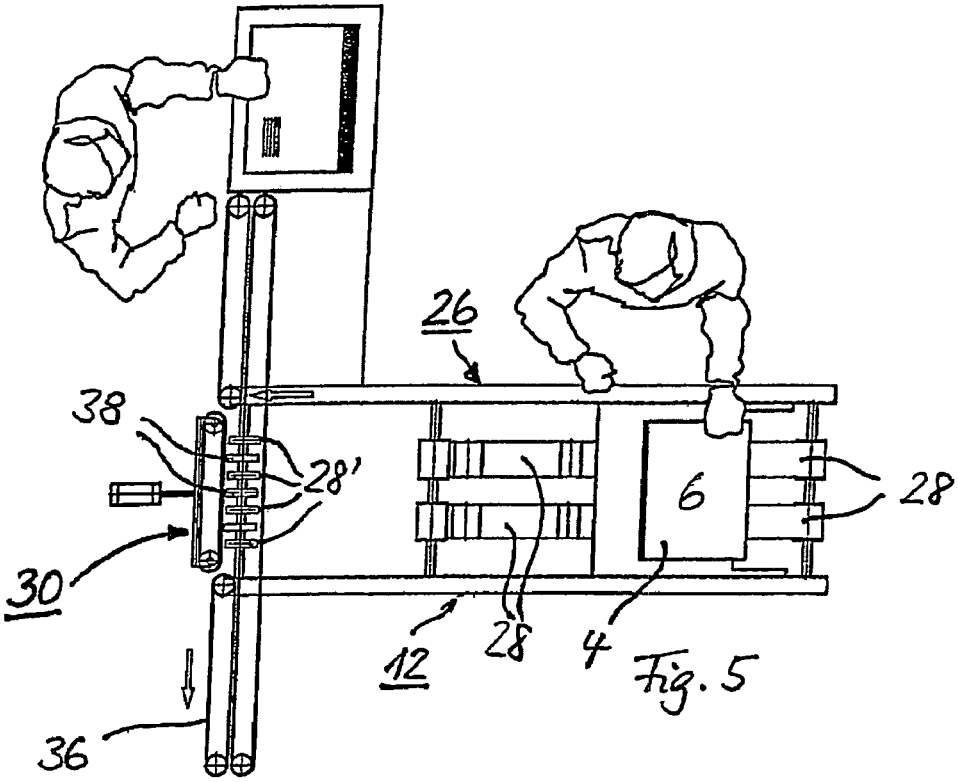
FIG. 5 a schematic diagram of an overhead view of a third positioning device with downstream input device.
Figure 6:
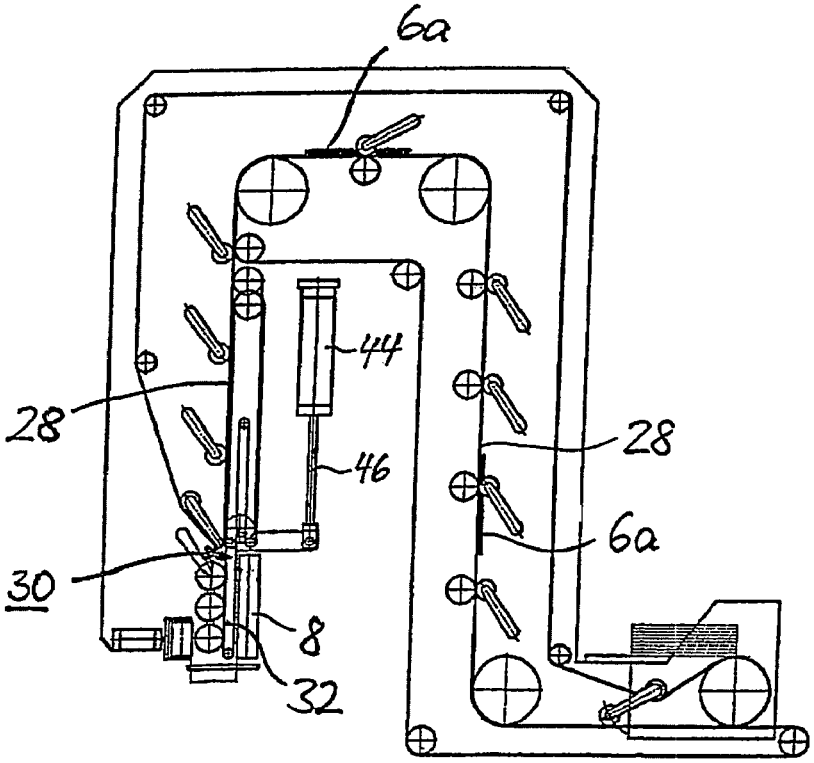
FIG. 6 a schematic diagram of a side view of the third positioning device.

In the third positioning device 12 with further slight changes compared to the first and the second positioning device 2 or 10, it can be clearly seen from FIGS. 5 and 6 that the article to be sorted 6*a* is transferred in a vertically downwards direction onto the carriage 32 of the telescopic unit 30. In this way it is possible to greatly simplify this variant of the embodiment of the input device 8 to the extent where the conveying section for turning the articles to be sorted 6*a* from the horizontal into the vertical position has become obsolete. The feed and obtaining the advance by the outwards movement of the carriage 32 however are principally unchanged with this variant principle compared to the two preceding variants.

Figure 7:
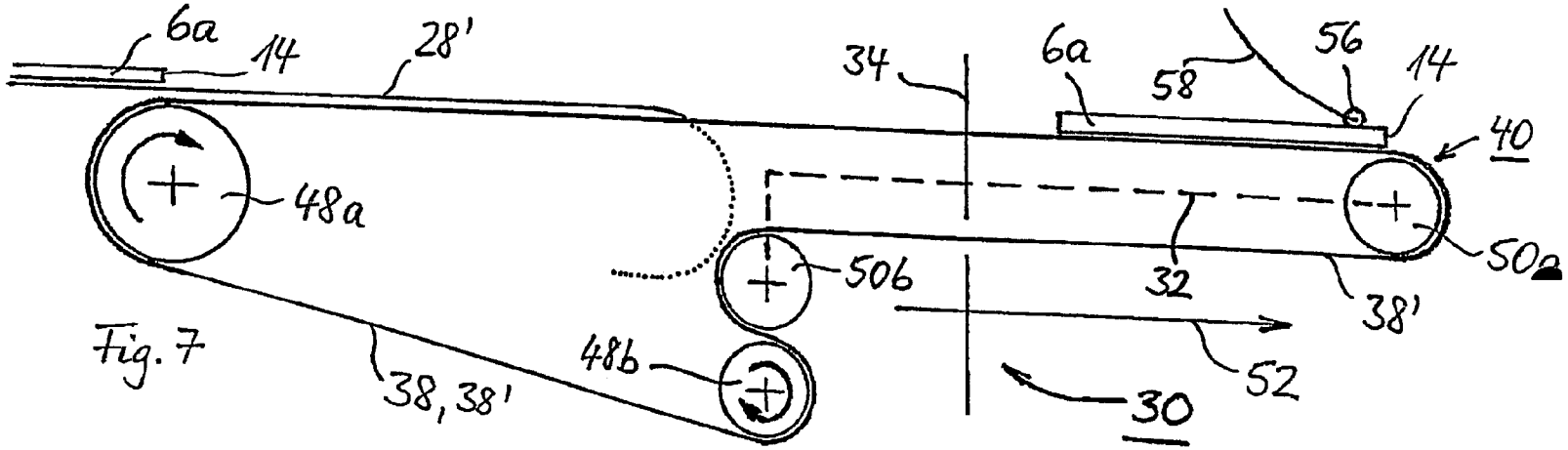
FIG. 7 a schematic diagram of a side view of a telescopic unit in the ejected state.
Figure 8:
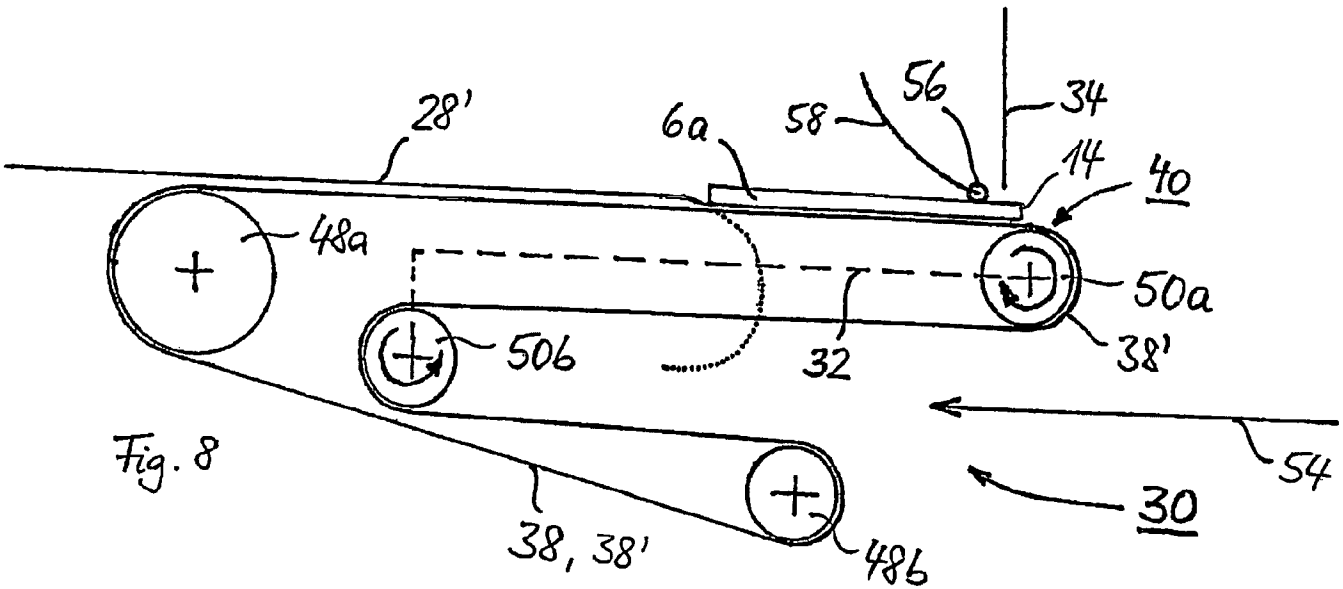
FIG. 8 a schematic diagram of a side view of the telescopic unit in accordance with FIG. 7 in the inserted state, and FIG. 9 a schematic diagram of a side view of a fourth positioning device with a vertical transfer device.

Schematic diagrams of an especially preferred embodiment variant for the telescopic unit 30 are shown in FIGS. 7 and 8. In accordance with the embodiment the telescopic unit 30 comprises a number of conveyor belt systems 38 of which each represents one conveyor belt strip. The way in which the unit functions will be explained below with reference to these conveyor belt systems 38. Each conveyor belt system 38 has two pairs of rollers 48, 50 coupled by a closed belt 38', each comprising two rollers 48*a* and 48*b* or 50*a* and 50*b*. In this case the relative position of the two rollers 48*a* and 48*b* or 50*a* and 50*b* in relation to each other is fixed within a pair of rollers 48, 50. The pair of rollers 48 is arranged at a fixed point on the telescopic unit 30 and the other pair of rollers 50 is attached to the carriage 32 which moves outwards in the direction of an arrow 52 and inwards in the direction of an arrow 54.

In the exemplary embodiment the rollers 48*b* and 50*b* each feature a freewheel where the rollers 48*b* are blocked in the anti-clockwise direction and the rollers 50*b* in the clockwise direction. The result of this is that when the carriage 32 moves outwards the belt 38' only rolls over the rollers 48*a* and 48*b* of fixed pair of rollers 48, in which case the two rollers 48*a* and 48*b* roll in the clockwise direction. In this way the article to be sorted 6*a*, once it has reached the light barrier 34, no longer changes its position relative to roller 50*a* when the carriage moves outwards which is what is absolutely intended. This arrangement is intentionally different during the inwards movement, in which the belt 38' only rolls over the rollers 50*a* and 50*b* attached to the carriage 32, with roller 50*a* rolling in the clockwise direction and roller 50*b* in the anticlockwise direction. Thus the article to be sorted 6*a* does not "sense" this at all for the inwards movement but retains its end position obtained with the outwards movement as required. The leading edge 14 of the article to be sorted 6*a* thus always comes to rest exactly at the desired point on the input device 8. To support this process a sprung plate 58 equipped with rollers 56 is provided which lightly presses the article to be sorted 6*a* onto the adhesive conveyor belt 38' during the outwards movement and during the inwards movement rolls back over the article to be sorted 6*a*—frictionless with the article to be sorted 6*a*.

It can also very clearly be seen that the conveyor belt 38' is arranged a little below the conveyor belt 28' which can also be seen as being associated with conveyor line 26, so that even when the carriage 32 is moving inwards, a new article to be sorted 6*a* can be fed above it up to the light barrier 34. This area can thus be seen as a type of transfer zone for the transition from the conveyor line 26 to the telescopic unit 30.

Figure 9:
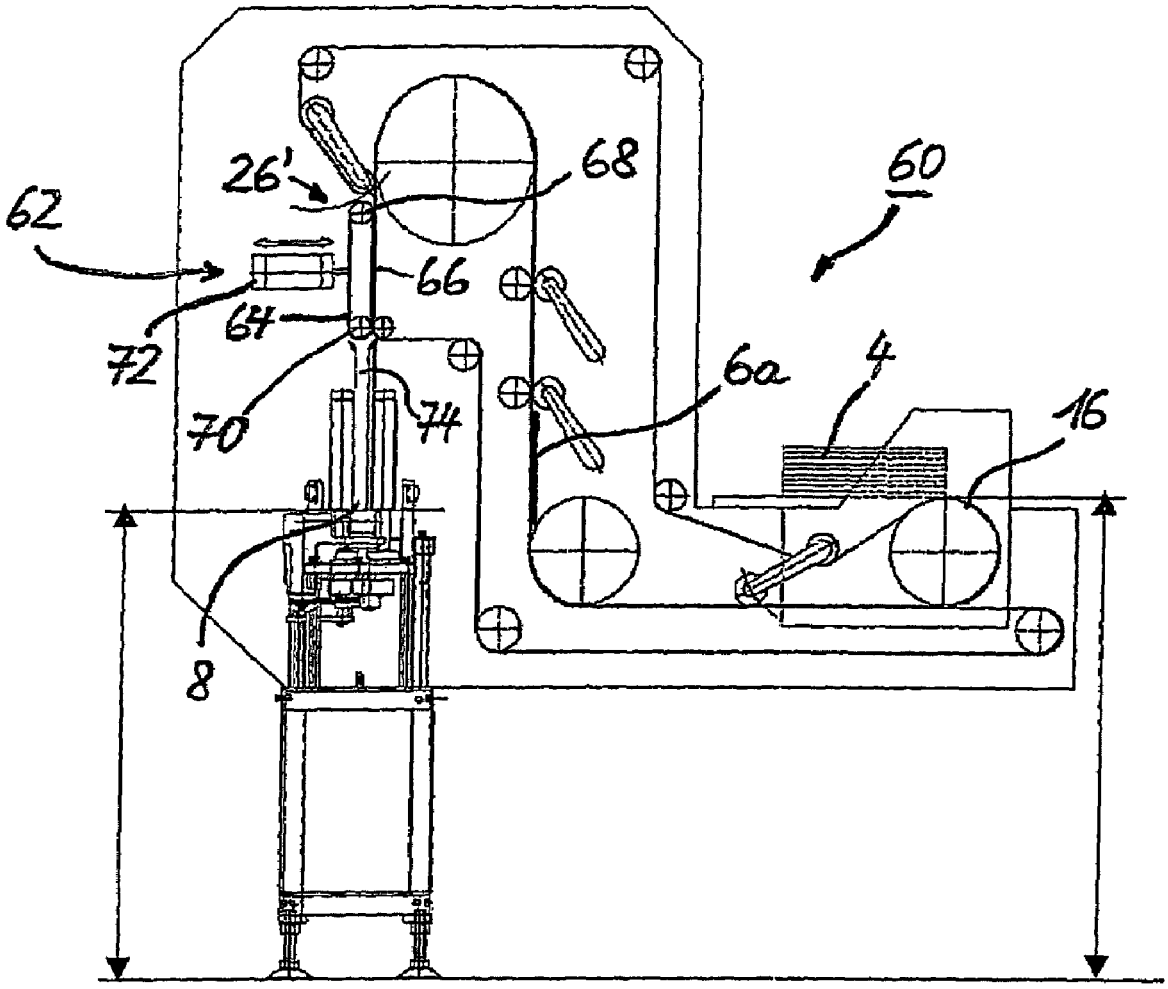

FIG. 9 shows a schematic diagram of a side view of a fourth positioning device 60, which is related to the third positioning device 12, but instead of a telescopic unit 30 is embodied with a vertical transfer device 62. The outstanding features of this fourth positioning device 60 is that a section 26' of the conveyor line 26 immediately preceding the predetermined conveyance point is aligned essentially vertically, with this section 26' of the conveyor line 26 comprising a pair of belts 64, 66 used for carrying the article to be sorted 6*a*, with one belt 66 of the pair 64, 66 being routed around two rollers 68, 70 and the other belt 64 of the pair 64, 66 being able to be lifted for a predetermined time. In this way the predetermined advance in accordance of the article to be sorted 6*a* with the invention is implemented within the framework of a free-fall section which ends with the arrival of the article to be sorted 6*a* on the input device 8. Thus the article to be sorted 6*a* lies as required directly with the leading edge 14 on the input device 8 and be fed into the sorting conveyor in this way. As well as achieving the desired advance without too many moving parts, this positioning device 60 stands out on the one hand by virtue of its space-saving design and on the other that especially the articles to be sorted 6*a*, in which loose sheets projecting over the edge are inserted, can be fed reliably without the inserted sheets being lost or material jams and other such faults occurring.

In detail there is provision here for a sensor which is arranged just slightly down from roller 70 to record the exit of the article to be sorted 6*a* with a corresponding predetermined length from the conveyor pair 64, 66 and so by suitable control means 72 to initiate the lifting of belt 64. The duration of this lifting is selected in this case such that the duration of the lifting process is matched to the cycle time of the sort article feed and to the length of the article to be sorted 6*a*.

In order to facilitate the entry of the temporarily freely falling article to be sorted 6*a* there is provision, seen in the direction of conveyance after band pair 64, 66 for an input-side dovetail expanded drop channel 74 which comes out in input device 8.

In a way not shown in any greater detail here the capacity of all the positioning devices 2, 10, 12 and 60 illustrated can be increased by in each case, before the section for achieving a predefined advance, a branch being included in the conveyor line 26 which distributes over different advance paths the flow of articles to be sorted 6*a* generated by the separation drum 16, which means for example that two telescopic units 30 or two vertical transfer units 62 can be operated in parallel. Naturally a third or fourth etc. function operated in parallel is also conceivable. In the final analysis it may only be the speed of the separation unit which is the limiting factor, which to function correctly requires sensible system limits to be set for the more or less unlimited upper capacity.

LIST OF REFERENCE NUMBERS

2 First positioning device
4 Stack
6 Flat articles to be sorted
6*a* Separated flat article to be sorted
8 Input device
10 Second positioning device
12 Third positioning device
14 Leading edge
15 Draw-off unit
16 Separation drum
18 Support
20 Suction cups
22 Lever
24 Support
26 Conveyor line
28 Strip-type conveyor belts of the conveyor line
28' Last strip-type conveyor belts arranged in the conveyor line
30 Telescopic unit
32 Carriage
34 Light barrier
36 Conveyor belt
38 Conveyor belt system
38' Belt
40 Front edge of carriage 32
42 Roller element
44 Pneumatic-unit
46 Push rod
48, 50 Pair of rollers
48*a*, 48*b* Rollers of pair 48 50*a*,
50*b* Rollers of pair 50
52, 54 Arrow for direction of insertion or ejection movement
56 Rollers
58 Spring plate
60 Vertical transfer direction
62 Vertical transfer direction 64, 66 Pair of belts
68, 70 Rollers
72 4 Control means

What is claimed is:

1. A device for effecting the positionally accurate conveyance of flat articles to be sorted to an input device for a sorting conveyor, comprising:

a draw-off unit arranged to periodically separate the flat articles to be sorted, and to feed the flat articles to be sorted in separated form onto a conveyor line; and a feed unit arranged to transfer the separated articles to be sorted with a defined advance to the input device after these articles to be sorted have reached a predetermined conveyance location of the conveyor line, wherein a section of the conveyor line immediately preceding the predetermined conveyance location is arranged substantially vertically, wherein the section of the conveyor line comprises a pair of belts for guiding the article to be sorted, with one belt of the pair running around two rollers and the other belt of the pair configured to be raised for a predetermined time.

2. The device according to claim 1, wherein a duration of the raising is adaptable to a cycle time of the sorted articles feed.

3. The device according to claim 1, wherein in the direction of conveyance, after the pair of belts, the device further comprises an input-side dovetail expanded drop channel arranged to come out into the input device.

4. The device according to claim 1, wherein the articles to be sorted have a leading edge and the articles to be sorted can be stacked in the draw-off unit and transferred by their forward leading edge to the conveyor line.

5. The device according to claim 1, wherein the draw-off unit comprises a drum-type rotatable unit having suction cups and a transport protection element, the suction cups arranged to grip the articles to be sorted closest to the drum and subsequently with the transport protection element for an edge, in particular the leading edge, of the article to be sorted gripped by the suction cups to be gripped.

6. The device according to claim 5, further comprising means for reducing vacuum of the suction cups and means for the removing the transport protection element from the edge.

7. The device according to claim 1, wherein the predetermined conveyance location is represented by at least one of a light barrier assigned to the conveyor line and a movement sensor assigned to the conveyor line.

8. The device according to claim 1, wherein the predetermined conveyance location is represented by an end of the conveyor line.

9. The device according to claim 1, further comprising a section enabling the articles to freely fall into the input device after the belt has been raised.

10. The device according to claim 1, wherein the section includes a drop channel.

* * * * *